US005771493A

United States Patent [19]

Proctor

[11] Patent Number: 5,771,493

[45] Date of Patent: Jun. 30, 1998

[54] HEAD WEAR ACCESSORIZATION SYSTEM

[76] Inventor: Michael K. Proctor, 1000 Dutch Canyon Rd., Midway, Utah 84049

[21] Appl. No.: 585,444

[22] Filed: Jan. 16, 1996

[51] Int. Cl.[6] ..... A42B 1/24

[52] U.S. Cl. ..... 2/209.13; 2/171.1; 2/175.3; 2/175.6; 2/183; 2/195.1; 2/195.2

[58] Field of Search ..... 2/171.1, 175.3, 2/175.6, 183, 195.1, 195.2, 209.13, 418, 420, 244

[56] References Cited

U.S. PATENT DOCUMENTS

| | | | |
|---|---|---|---|
| 3,166,766 | 1/1965 | Banello, Jr. | 2/175.6 |
| 3,428,963 | 2/1969 | Centeck | 2/133 |
| 3,671,974 | 6/1972 | Sims | 2/3 |
| 4,063,740 | 12/1977 | Mader | 273/183 |
| 4,268,918 | 5/1981 | Lee | 2/199 |
| 4,304,005 | 12/1981 | Danley, Sr. | 2/10 |
| 4,545,310 | 10/1985 | Treadwell et al. | 112/121 |
| 4,821,341 | 4/1989 | Baptise | 2/10 |
| 4,961,232 | 10/1990 | Hulsey . | |
| 4,980,928 | 1/1991 | Ellis | 2/88 |
| 5,046,195 | 9/1991 | Koritan | 2/172 |
| 5,121,507 | 6/1992 | Brown | 2/199 |
| 5,509,144 | 4/1996 | Soergel et al. | 2/195.1 |
| 5,509,145 | 4/1996 | Stevenson et al. | 2/171.1 |
| 5,530,970 | 7/1996 | Knutson | 2/209.13 |

*Primary Examiner*—Diana Biefeld
*Attorney, Agent, or Firm*—Workman, Nydegger & Seeley

[57] ABSTRACT

A head wear system including a sizing band and a hat. The sizing band is distinct from the hat. The hat comprises a bill and a cap having an opening at the back as well as a headband. The head wear system also includes a first and second adjustment means for selectively nondestructively attaching each end of the sizing band to the hat in a longitudinal relationship therebetween selected by the wearer. When the sizing band is attached to the hat by the first and second adjusting means, the sizing band extends across the opening of the cap. The head wear system also comprises an ornament, a cover means for accessorizing the hat, and an attachment means for selectively nondestructively connecting the cover means and ornament to the crown of the cap. One embodiment of the sizing band functions as a skin stencil and comprises a substrate transparent to ultraviolet radiation and a design opaque to ultraviolet radiation that is attached to the substrate. When the substrate contacts the skin of a wearer the ultraviolet radiation causes the skin under the substrate to tan. At the same time, the design blocks the ultraviolet radiation and causes the skin directly under the design to be unaffected by the ultraviolet radiation resulting in a shadow having the configuration of the design being formed in the skin of the wearer.

27 Claims, 6 Drawing Sheets

HEAD WEAR ACCESSORIZATION SYSTEM

BACKGROUND

1. Field of the Invention

The present invention relates to head wear systems and in particular to head wear systems that afford for the selective accessorization and sizing of head wear.

2. Background Art

Head wear serves many functions and purposes. Head wear is worn to protect the head or other parts of the upper body from ambient weather conditions, to prevent injury to the head, to retain the hair in windy conditions, to protect the head from blowing dust, to keep sweat from the scalp from draining over the face, and in some cultures to show respect and modesty. Almost every type of head wear is, however, available in a variety of styles and shapes.

As a result head wear may also serve as an ornamental component of a wardrobe having the potential to attract attention to the wearer or to make a statement relative to the identity or group association of the wearer.

The basic component of most head wear in western cultures is the hat. Hats have several common features. The top portion of a hat is often referred to as the crown. Most hats have a closed crown. The inside of the bottom or base portion of a hat contacts the head of a wearer above the ears and is referred to as the headband. Most hats are made with the headband having a specific size, but some hats are constructed so as to be adjustable to the size of each individual wearer. Some styles of hats have a brim, a bill, or one or more flaps attached to the base of the hat at various locations and that project or depend therefrom as determined by fashion or the intended utility of the brim, bill, or flap. Some hats even have eye protection attached to the headband.

A popular type of hat referred to as a baseball-style hat comprises a cap that closely covers the crown of the head and a bill that extends outwardly from the front of the cap. The cap of the hat protects the head of the wearer and the bill keeps the sun out of the eyes and off the face of the wearer. Even this style of hat, however, has numerous variations. The headband of a baseball-style hat completely encircles the head of a wearer, although the rear of a baseball-style hat is frequently provided with an opening that affords for ventilation of the head of the wearer. A baseball-style hat with such an opening is also thereby enabled to be selectively sizable. The sizing system bridges the opening and together with the headband encircles the head of a wearer.

Sizing systems for the baseball-style hat use sizing bands that are permanently attached to the base of the cap at each side of the opening. The sizing bands extend across the opening and are attachable in a longitudinal relationship determined by the wearer. The baseball-style hat cannot be worn unless the sizing bands are thusly connected across the opening. Should either sizing band become broken or damaged, the hat becomes useless.

A hat is most often used as protection against precipitation, sun, or cold. There are many types of head wear available that provide protection against the weather. One type of hat is made for the specific purpose of providing protection against the sun. The head wear has a permanently attached and downwardly extending rear flap that covers the back of the neck. A headband that is attached to the head wear has elastic portions along the sides of the head wear making the head wear adjustable to the correct size. Attached to the outside of the headband is eye protection that can be lowered as needed.

A disadvantage with this head wear is that should the rear flap not be needed, the entire head wear must be removed. In addition, the head wear provides little protection from adverse weather other than sun or wind.

A baseball-style hat with a depending flap that covers the neck of a wearer can also be used. The flap is secured directly to the bottom of the back portion of the head wear and may be either detachable or permanently attached to the hat. The flap only protects the wearer from sunburn.

Other types of hats are made specifically to keep precipitation off the head and out of the eyes of the wearer. One type of rain protection is head wear that includes a deployable cape. The head wear may be in the form of a cap, a visor, or a headband. Stowed inside the head wear against the inner lining or inside the inner lining is a cape which may be deployed. When deployed the cape extends below the bottom of the head wear and is draped around the shoulders, back, and chest of the wearer. The inner lining retains heat from the head of the wearer inside the head wear. The lack of breathability causes an even more serious problem if the precipitation stops and the temperature increases. The cape will be restored inside the hat and will retain even more heat because of the further reduced breathability and ventilation. The hat with the cape stowed either against the inner lining or inside the lining, will also be heavy and may be tiresome for the wearer. Because the cape is permanently attached to the head wear, there is no way to avoid this problem.

Stowing the cape may result in an uneven surface contacting the head of a wearer. In addition, the head wear will fit differently when the cape is stowed than when the cape is deployed.

A U-shaped clip can be used to connect a downwardly extending flap that covers the neck and ears of a wearer to the base of the head wear. The U-shaped clip has a hook and pile fastener, such as a VELCRO® brand hook and pile fastener, mounted on the outside surface of one of the upstanding sections of the U-shaped clip. Mounted on the flap is a cooperating hook and pile fastener. The U-shaped clip is attached to the headband of the head wear by the U-shaped channel forcibly engaging the base of the head wear.

A problem with using a U-shaped clip is that part of the U-shaped clip is inside the head wear and contacts the head of the wearer. An additional drawback is that the accessories extend only below the base of the head wear.

The problem with the weather is that it changes, sometimes quickly and unpredictably. A hat that is waterproof and protects the wearer from the rain, may be overly warm and uncomfortable when the sun comes out. Similarly, a hat that is light and cool for hot sunny weather does not offer significant protection against a sudden rain shower. A hat that is a comfort in cold weather may be too hot if the temperature rises. A hat that is made to protect the ears or the neck from inclement weather becomes burdensome in the sunshine.

The specific weather conditions for which a hat is worn may not endure. Each hat is manufactured to have a specific utility and is not able to accommodate changing conditions. The wearer has to own multiple head wear, each specifically adapted to distinct weather conditions.

Hats have become popular for reasons other than utility.

When head wear is used as an ornamental component of a wardrobe the wearer may want to vary the look of the hat, so as to avoid appearing to wear the same hat day after day. This requires owning multiple hats and may become costly. Other hat wearers are more concerned with being able to personalize the hat or have the hat reflect the interests or group associations of the wearer. Accommodating these concerns requires owning multiple hats and again is costly. A hat may be used to reflect personal loyalties or tastes, such as an interest in sports, that the wearer has been to a specific event, or that the wearer is loyal to a certain manufacturer, employer, media corporation, political candidate, or special interest group. The taste or interest of a wearer may change, but the visual indicia on the hat is permanent. The wearer must own multiple hats to vary the appearance of the head wear.

Head wear that is used as an ornamental component of the wardrobe includes those hats that are used either as part of a costume or as novelty head wear. There are many types of novelty head wear. One of the most common is a hat having permanently attached animal features. To wear a different animal feature or wear more conventional head wear, multiple hats must be owned.

One way wearers use a hat as an ornamental component of their wardrobe is to wear a hat rotated at various positions about the head so that the sizing band contacts the forehead of a wearer. Prolonged exposure to ultraviolet radiation results in a line on the skin of the wearer from the sizing band that may become visible when the hat is removed.

OBJECTS AND SUMMARY OF THE INVENTION

It is an object of the present invention to provide versatile head wear that can adapt to changing and various weather conditions.

It is another object of the present invention to protect the head wear and wearer from multiple types of weather conditions.

It is a further object of the present invention to provide head wear that will protect the head and neck of a wearer from rain and sun, but which may also be worn without such weather protection and without having to alter the inside surface of the cap to store the sun or rain protection.

It is a further object of the present invention to be able to protect other parts of the body of the wearer with the same hat that can also be worn only as a head cover.

It is an object of the present invention to allow one hat to be used for a variety of reasons including weather protection, wind protection, and head protection.

It is an object of the present invention to have one hat that can be used in a variety of ways as a clothing accessory.

It is an additional object of the present invention to provide a selective sizing band that can be personalized.

It is an object of the present invention to provide head wear that can be selectively personalized.

It is further an object of the present invention to be able to use one hat for several personal expression purposes.

It is a further object of the present invention to provide a sizing band that also functions as a skin stencil.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a head wear system is provided that comprises a hat and a sizing band. The sizing band is distinct from the cap and has a first and a second end. The hat comprises a bill and a cap having an opening at the back which interrupts the base of the cap. The opening has a first side and a second side. The portion of the base along the inside of the cap between the first and second side of the opening defines a headband having a first end at the first side of the opening and a second end at the second side of the opening. The bill is attached to the base of the cap at said front thereof, and extends outwardly from the front of the cap.

According to one aspect of the present invention the head wear system includes a first adjustment means for selectively nondestructively attaching the first end of the sizing band to the first end of the headband in a longitudinal relationship therebetween selected by the wearer. According to another aspect of the present invention, the head wear system also includes a second adjustment means for selectively nondestructively attaching the second end of the sizing band to the second end of the headband in a longitudinal relationship therebetween selected by the wearer.

When the sizing band is attached to the hat by the first and second adjusting means, the sizing band extends across the opening and with the headband forms a generally continuous path encircling said head of a wearer. In one embodiment of such a first and second adjustment means each may comprise a first member and a second member, releasably cooperable with said first member, to engage said first member.

In another aspect of the present invention, the head wear system includes a hat comprising a cap and a bill, an ornament, and a cover means for accessorizing the hat. The bill is attached to the base of the cap at the front thereof, and extends outwardly from the cap.

According to one aspect of the present invention, the head wear system further comprises an attachment means for selectively nondestructively connecting the cover means and said ornament to the crown of the cap. According to the teachings of the present invention one embodiment of the cover means comprises a panel that overlies the crown of the cap and a skirt that extends radially outward from the panel. In one embodiment the attachment means comprises a first element and a second element, releasably cooperable with said first element, to engage said first element.

According to the teachings of the present invention, one embodiment of the head wear system includes a sizing band comprising a substrate transparent to ultraviolet radiation and a design opaque to ultraviolet radiation that is attached to the substrate. When the substrate contacts the skin of a wearer the ultraviolet radiation causes the skin under the substrate to tan, but the design blocks the ultraviolet radiation and causes the skin directly under the design to be unaffected by the ultraviolet radiation. This results in a shadow having the configuration of the design being formed in the skin of the wearer.

In one embodiment of the head wear system, the sizing band which functions as a skin stencil is distinct from the hat and has a first and second end. According to one aspect of the present invention, the head wear system includes a first adjustment means for selectively nondestructively attaching the first end of the sizing band to the first end of the headband in a longitudinal relationship therebetween selected by the wearer. According to the teachings of the present invention, this embodiment of a head wear system also includes a second adjustment means for selectively nondestructively attaching the second end of the sizing band to the second end of the headband in a longitudinal relationship therebetween selected by the wearer.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
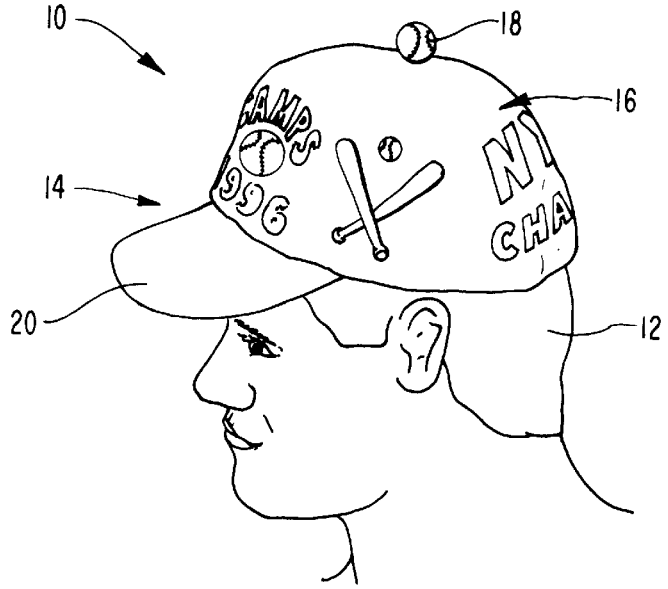
FIG. 1 is a perspective side view of a first embodiment of a head wear system incorporating teachings of the present invention in use by a wearer.

The present invention relates to a head wear system 10, illustrated in FIG. 1. The primary element of head wear system 10 is a hat which may be of any style or embodiment. One embodiment of a hat is a baseball-style hat 14. According to one aspect of the present invention, head wear system 10 may be provided with a cover means for accessorizing a hat, such as hat 14. As shown by way of example and not limitation in FIG. 1, one possible embodiment of a structure performing the function of such a cover means comprises a cover 16. In FIG. 1, a wearer 12 is shown wearing one embodiment of head wear system 10 which includes hat 14, cover 16, and an ornament 18. Head wear system 10 also comprises a sizing band that is concealed from view by cover 16. The sizing band will be discussed in more detail below.

Figure 2:
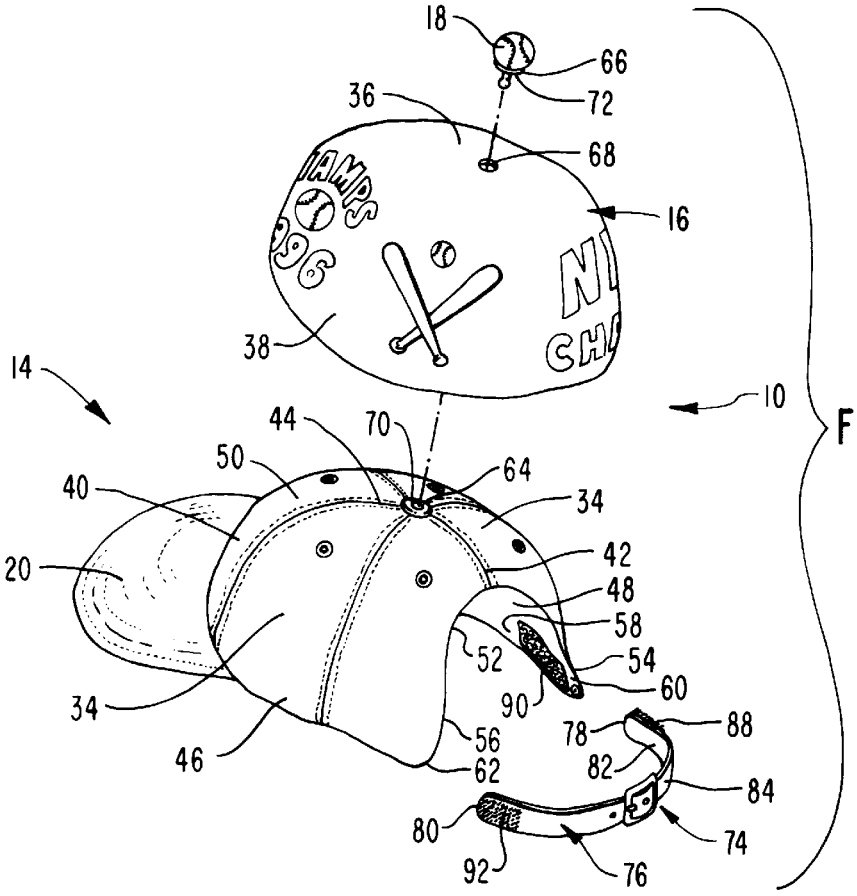
FIG. 2 is an exploded perspective view of the embodiment of a head wear system shown in FIG. 1.

As best shown in FIG. 2, hat 14 comprises a bill 20 and a cap 34. The term cap refers to the portion of hat 14 that covers the crown of the head of wearer 12, regardless of the style of hat. Cap 34 has a front 40, a back 42, a crown 44, and a base 46. Bill 20 is attached to base 46 of cap 34 at front 40 thereof, and extends outwardly from front 40 of cap 34. Cap 34 also has an inside 48, an outside 50, and an opening 52 interrupting base 46. Opening 52 could be located anywhere along base 46, however, in the embodiment of cap 34 shown in FIG. 2, opening 52 is located at back 42 of cap 34. Opening 52 may be of any size or shape, but has a first side 54 and a second side 56.

Cap 34 also has a headband 58 that extends from first side 54 of opening 52 along inside 48 of base 46 to second side 56 of opening 52. Headband 58 contacts the head of wearer 12 and has a first end 60 and a second end 62. First end 60 of headband 58 is disposed at first side 54 of opening 52, while second end 62 of headband 58 is disposed at second side 56 of opening 52.

According to one aspect of the present invention, head wear system 10 may also be provided with a cover means for accessorizing a cap, such as cap 34. As shown by way of example and not limitation in FIG. 2, one possible embodiment of a structure performing the function of such a cover means comprises cover 16 having a panel 36 and a skirt 38 which are closely contoured to the actual shape of outside 50 of cap 34. Panel 36 covers crown 44 of cap 34, while skirt 38 extends radially outward from panel 36 to be coextensive with the bottom of cap 34. Alternatively, panel 36 may be of such a length as to extend beyond base 46 of cap 34 to cover the neck or ears, and even the shoulders or torso, of wearer 12.

Various embodiments of a cover means that allows accessorization of hat 14 are equally effective in carrying out the intended function thereof. A cover means may also be used to display any type of visual indicia. Any embodiment of a cover means may also comprise a water resistant material.

According to one aspect of the present invention, head wear system 10 may be provided with an attachment means for selectively and nondestructively connecting a cover, such as cover 16, to crown 44 of cap 34 and for selectively and nondestructively connecting an ornament, such as ornament 18, to cap 34. As shown by way of example and not limitation in FIG. 2, one possible embodiment of a structure performing the function of such an attachment means is a snap comprising a female or first snap element 64 and a male or second snap element 66.

A male and female snapping arrangement is shown in FIG. 2, but various embodiments of an attachment means utilizing a snapping arrangement that allows selective nondestructive attachment is equally effective in carrying out the intended function thereof. In addition, the position of the male and female snap element could be reversed. Modifying the way the attachment means is connected to cap 34 or the specific configuration of the first snap element 64 and second snap element 66 is equally effective in carrying out the intended function thereof.

Other possible embodiments of the attachment means may be, but are not limited to, such conventional methods as a hook and pile fastener, or a hook and eye. The attachment means in any form comprises a first element and a second element, and the following discussion applies to all embodiments of the attachment means.

In FIG. 2, first snap element 64 of the attachment means is connected to crown 44 of cap 34 by conventional methods. Panel 36 of cover 16 has an aperture 68 formed through the interior of the perimeter thereof. Second snap element 66 of the attachment means selectively and nondestructively engages first snap element 64 through aperture 68. First snap element 64 and second snap element 66 each have a cooperating mating side, 70 and 72 respectively. First snap element 64 releasably and snappingly retains mating side 72 of second snap element 66 against mating side 70 of first snap element 64. Second snap element 66 is completely detachable from first snap element 64 and cover 16.

Ornament 18 is mounted to second snap element 66 at a location distinct from mating side 72. In FIG. 2, by way of example and not limitation, ornament 18 is configured as a baseball. Ornament 18 may, however, take any form. Ornament 18 and second snap element 66 of the attachment means may be interchanged with a similarly configured second snap element 66 to vary or personalize the appearance of cap 34.

In addition, it is contemplated that the term ornament encompasses other embodiments such as enveloping the second element of the attaching means with a colored material, for example, cloth, plastic coating, or paint, in addition to items mounted to the second element at a location distinct from the mating side of the second element.

Head wear system 10 also comprises a generally elongated sizing band 76 that is distinct from cap 34. Sizing band 76 has a first end 78, a second end 80, an inside surface 82, and an outside surface 84. Sizing band 76 may also comprise a decoration 74. For example, outside surface 84 of sizing band 76 may carry decoration 74 by which to personalize sizing band 76 and thus cap 34 with which sizing band 76 is used. Decoration 74 may alternatively be integral with sizing band 76. In one embodiment of a sizing band, decoration 74 has the configuration of a buckle, as illustrated in FIG. 2. Sizing band 76 may assume a variety of configurations without affecting the essential function thereof. Many other embodiments of decoration 74 are also possible.

Sizing band 76 and decoration 74 associated therewith may match or be related in style or theme to ornament 18. Either one or both of sizing band 76 or decoration 74 associated therewith may harmonize with the theme of the cover means. Head wear system 10 is designed so wearer 12 can be individualistic and wear any combination of ornament 18, sizing band 76, and cover means that is desired. Head wear system 10 does not require that the cover means even be worn.

According to one aspect of the present invention, head wear system 10 comprises a first adjustment means for selectively nondestructively attaching first end 78 of sizing band 76 to first end 60 of headband 58 in a longitudinal relationship selected by the wearer. As shown by way of example and not limitation in FIG. 2, one possible embodiment of a structure performing the function of such a first adjustment means comprises a first member 88 and a second member 90. First member 88 of the first adjustment means is attached to outside surface 84 of first end 78 of sizing band 76. Second member 90 of the first adjustment means is attached to first end 60 of headband 58.

According to one aspect of the present invention, head wear system 10 also comprises a second adjustment means for selectively nondestructively attaching second end 80 of sizing band 76 to second end 62 of headband 58 in a longitudinal relationship therebetween selected by the wearer. As shown by way of example and not limitation in FIG. 2, one possible embodiment of a structure performing the function of such a second adjustment means comprises a first member 92 and a second member. Second member of the second adjustment means is not visible in FIG. 2, however, it has the same configuration as second member 90 of the first adjustment means. First member 92 of the second adjustment means is attached to outside surface 84 of second end 80 of sizing band 76. Similarly, second member of second adjustment means is attached to second end 62 of headband 58.

In one embodiment of head wear system 10 illustrated in FIG. 2, both the first and second adjustment means are longitudinally adjustable. An alternate embodiment of the adjustment means where only the first adjustment means allows longitudinal adjustment is equally effective in carrying out the intended function thereof. Sizing band 76 would still be distinct from cap 34. In this alternate embodiment of the adjustment means, however, second end 80 of sizing band 76 is selectively attachable to and detachable from second end 62 of headband 58. First member 92 is attached to second end 80 of sizing band 76 and second member is attached to second end 62 of headband 58. Second member is selectively nondestructively retained against first member 92 but is not longitudinally adjustable to size hat 14. In this alternate embodiment of the adjustment means, only the first adjustment means may be used to size hat 14.

Various embodiments of the first and second adjustment means using attaching methods that allow longitudinal adjustment are equally effective in carrying out the intended function thereof. Alternate embodiments of the adjustment means may comprise a hook and pile fastener, hook and eye fastener, or a plurality of protuberances and apertures adapted to receive the protuberances in a snapping arrangement. FIG. 2 illustrates, by way of example and not limitation, a hook and pile first and second adjustment means.

Alternate embodiments of the specific location, method of attachment to sizing band 76, and specific configuration of the first and second adjustment means are equally effective in carrying out the intended function thereof. For example and not limitation, first member 88 of the first adjustment means could be attached to inside surface 82 of first end 78 of sizing band 76. Second member 90 of the first adjustment means correspondingly could be aligned with first end 60 of headband 58 but attached to outside 50 of cap 34. Similarly, first member 92 of the second adjustment means would be attached to inside surface 82 of second end 80 of sizing band 76. Second member of second adjustment means would then be attached to outside 50 of cap 34 but aligned with second end 62 of headband 58.

The first and second adjustment means of one embodiment of head wear system 10 as illustrated in FIG. 2, comprise a hook and pile fastener. More specifically, first members, 88 and 92, of the first and second adjustment means comprise hooked locking fibers. Second members, 90 and, are corresponding pieces having cooperating eyelet fibers adapted to be releasably engaged to the hooked locking fibers on first members 88 and 92. Reversing the position of the hooked locking fibers and cooperating eyelet fibers would result in an equally effective first and second attachment means.

All embodiments of head wear system 10, particularly hat 14, may be worn at any desired angle or orientation on the head of wearer 12. For example, cap 34 may be worn with any embodiment of a sizing band contacting forehead 110 of wearer 12 as shown in FIG. 3.

Figure 3:
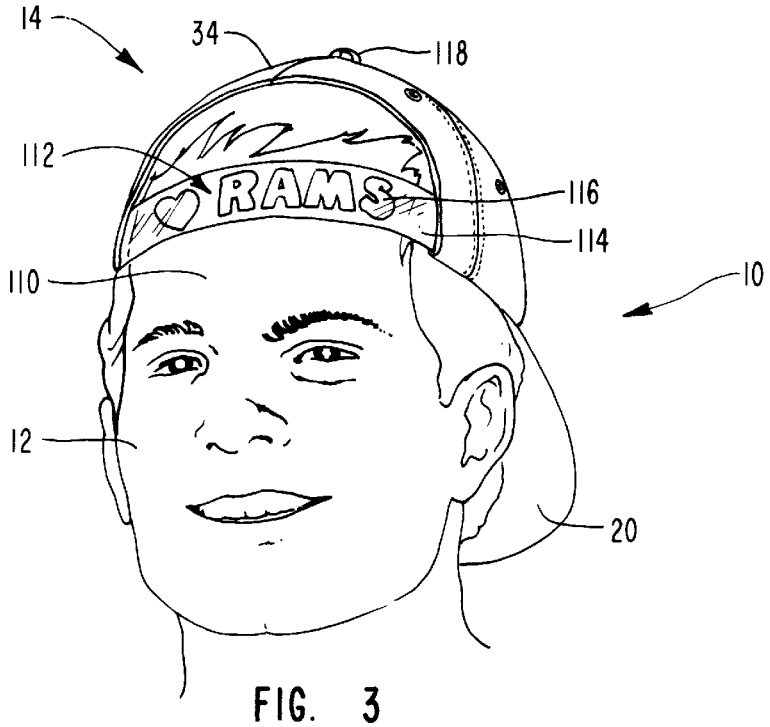
FIG. 3 is a perspective view of an alternate embodiment of a head wear system incorporating teachings of the present invention being used by a wearer with a sizing band that is a skin stencil positioned over the forehead.

FIG. 3 illustrates one embodiment of sizing band 112 that functions as a skin stencil. Sizing band 112 comprises a substrate 114 transparent to ultraviolet radiation. A design 116 opaque to ultraviolet radiation for personalizing sizing band 112 is connected to substrate 114. When substrate 114 contacts the skin of wearer 12, ultraviolet radiation causes the skin under substrate 114 of sizing band 112 to tan after extended exposure. Design 116 blocks the ultraviolet radiation and causes the skin directly under design 116 to be unaffected and a shadow having the configuration of design 116 is formed in the skin of wearer 12. By way of example, design 116 is a phrase, but various embodiments of design 116 such as any shape, design, word, or symbol, are equally effective in carrying out the intended function thereof.

Alternatively, a sizing band, such as sizing band 112, which functions as a skin stencil could be free of design 116. Thus, sizing band 112 could be comprised only of substrate 114, thereby causing no tan line to be formed on the skin of wearer 12. The discussion of the various methods of selectively nondestructively attaching sizing band 76 in FIG. 2 equally apply to sizing band 112 in FIG. 3.

An alternate embodiment of head wear system 10, also includes a sizing band which functions as a skin stencil. Contrary to sizing band 112 in FIG. 3, in this embodiment, the sizing band is not distinct from cap 34. In other words, the sizing band is not selectively nondestructively attached to cap 34 but is equally effective in carrying out the intended skin stencil function thereof.

A skin stencil is not required to be part of head wear system 10 and could be used alone or attached to other articles of clothing. In one embodiment of the skin stencil, similar to sizing band 112 in FIG. 3, comprises a substrate transparent to ultraviolet radiation and may include a design opaque to ultraviolet radiation attached to the substrate for personalizing the skin stencil. According to one aspect of the present invention, the skin stencil may be provided with a support means for holding the substrate at a fixed position on the skin of a wearer during exposure to ultraviolet radiation. One embodiment of structures performing the function of a support means according to the teachings of the present invention may be a hat, an article of clothing, or a band to attach the skin stencil to the body of the wearer.

Head wear system 10 does not require the cover means to always be worn. FIG. 3 illustrates head wear system 10 worn without a cover means. Head wear system 10 in FIG. 3 includes hat 14 comprising cap 34, bill 20, sizing band 112, and ornament 118. Head wear system 10 also comprises an attachment means for selectively nondestructively connecting ornament 118 to crown 44 of cap 34 that is not visible in FIG. 3. Adding a cover means to the head wear system 10 in FIG. 3 is equally effective in carrying out the intended function thereof, as long as sizing band 112 remains uncovered, so that ultraviolet radiation may penetrate sizing band 112 if desired.

Figure 4:
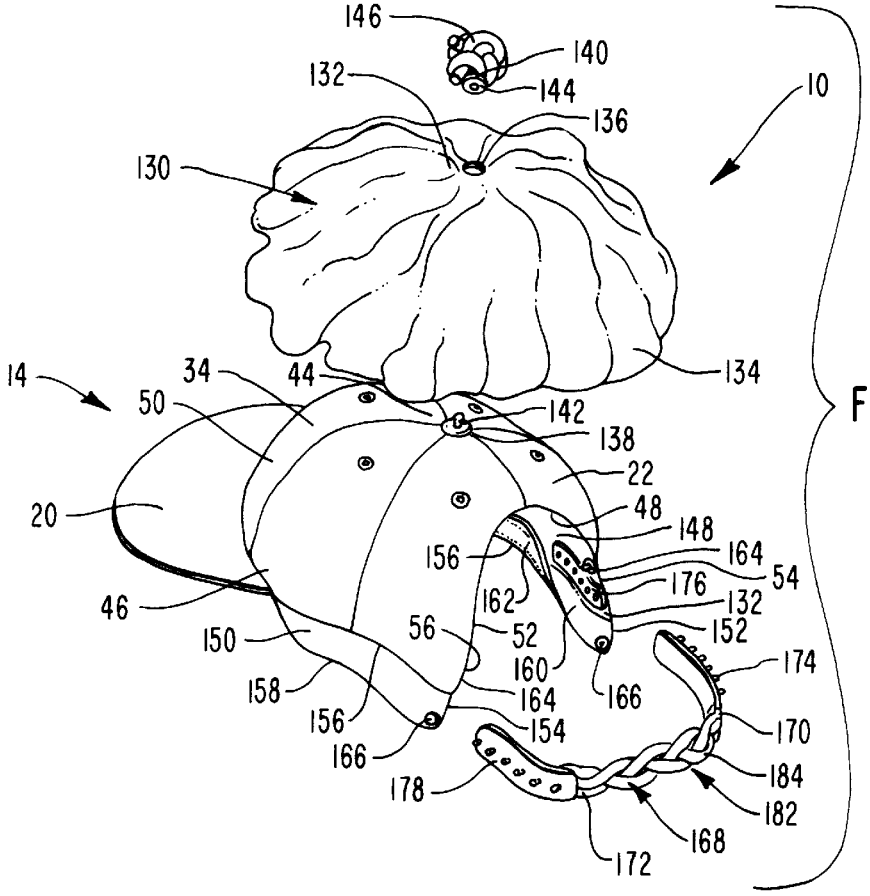
FIG. 4 is an exploded perspective view of an alternate embodiment of a head wear system incorporating teachings of the present invention and illustrating one embodiment of a cover and structures by which attach the cover to the hat of the system.

An alternate embodiment of structures performing the function of a cover means according to the teachings of the present invention is shown in FIG. 4. By contrast to cover 16 of FIGS. 1 and 2, cover 130 shown in FIG. 4, is not closely contoured to conform to outside 50 of cap 34. Instead, cover 130 is loose and blousy, comprising a panel 132 that covers crown 44 of cap 34 and a skirt 134 that extends radially outward from panel 132. Panel 132 and skirt 134 are loosely overlying cap 34 and have sufficient size to be formed into multiple shapes while attached to cap 34. An aperture 136 is formed through panel 132 interior of the perimeter thereof. Panel 132 is selectively nondestructively connectable to crown 44 of cap 34 by an attachment means with panel 132 overlying crown 44 of hat 14.

An alternate embodiment of structures performing the function of an attachment means according to the teachings of the present invention is also illustrated in FIG. 4. By contrast with the attachment means shown in FIG. 2, the attachment means in FIG. 4 reverses the position of the male and female snap elements.

Specifically, the attachment means illustrated in FIG. 4 comprises a first snap element 138 and a second snap element 140. First snap element 138 is connected to cap 34 and has a male configuration. Second snap element 140 releasably cooperates with first snap element 138 through aperture 136 and has a female configuration adapted to receive first snap element 138. Second snap element 140 is remote from cap 34.

First snap element 138 and second snap element 140 each have a cooperating mating side, 142 and 144, respectively. Mounted to second snap element 140 at a location distinct from mating side 144 of second snap element 140 is ornament 146. In this embodiment of head wear system 10, by way of example, ornament 146 is configured as a knot.

One embodiment of headband 148 is also shown in FIG. 4. In this embodiment, headband 148 comprises an elongated strip 150 having a first longitudinal edge 156 and a second longitudinal edge 158. Elongated strip 150 extends from first end 152 of headband 148 located at first side 54 of opening 52 in cap 34. The second end 154 of headband 148 is located at second side 56 of opening 52. Elongated strip 150 is attached to cap 34 by first longitudinal edge 156 being attached to base 46 of cap 34.

Elongated strip 150 also has a first surface 160 and a second surface 162. Elongated strip 150 folds into cap 34, so that first surface 160 of elongated strip 150 movably contacts inside 48 of cap 34. Second surface 162 of elongated strip 150 contacts the head of wearer 12. Various embodiments of headband 148 with elongated strip 150 attached by various connecting methods are equally effective in carrying out the intended function thereof.

According to one aspect of the present invention, head wear system 10 may be provided with a plurality of selective retaining means for securing first surface 160 of elongated strip 150 against inside 48 of cap 34. As shown by way of example and not limitation in FIG. 4, one possible embodiment of a structure performing the function of such a retaining means comprises conventional fasteners such as, snaps or hook and pile fasteners. The purpose of the retaining means is to assist in holding elongated strip 150 inside cap 34.

An alternate embodiment of a structure of a retaining means comprises a plurality of snaps releasably securing first surface 160 of elongated strip 150 against inside 48 of cap 34. Each retaining means comprises a first retaining member 164 and a second retaining member 166. A first retaining member 164 is located inside 48 of cap 34 at both first side 54 and second side 56 of opening 52. First retaining member 164 at second side 56 is not visible in FIG. 4, however, first retaining member 164 is the same as first retaining member 164 at first side 54 of opening 52.

A cooperating second retaining member 166 is attached to first surface 160 of elongated strip 150 at both first end 152 and second end 154 of headband 148 in a position that is aligned with each first retaining member 164. More snaps may be used in addition to the ones at first end 152 and second end 154 of headband 148 and this embodiment of the retaining means is equally effective in carrying out the intended function thereof.

One embodiment of sizing band 168 is also illustrated in FIG. 4. Sizing band 168 comprises decoration 182 that is integral with sizing band 168. Decoration 182 comprises a plurality of interwoven elongated members 184. Similar to sizing band 76 of FIG. 2, sizing band 168 in FIG. 4, has a first end 170 and a second end 172. First end 170 of sizing band 168 is attached to first end 152 of headband 148 by a first adjustment means. Second end 172 of sizing band 168 is attached to second end 154 of headband 148 by a second adjustment means.

An alternate embodiment of structures performing the function of the first and second adjustment means according to the teachings of the present invention are shown in FIG. 4. Sizing band 168 is attached to headband 148 in a longitudinal relationship therebetween selected by wearer 12 by the first and second adjustment means.

The first adjustment means comprises a first member 174 and a second member 176. First member 174, by way of example and not limitation, comprises an elongated flexible member having a series of protuberances that is connected to first end 170 of sizing band 168. Second member 176 of the first adjustment means is disposed between inside 48 of cap 34 and first surface 160 of elongated strip 150 at first end 152 of headband 148 when elongated strip 150 is tucked inside cap 34. Second member 176 of the first adjustment means has a series of corresponding apertures to receive the protuberances of first member 174 in a longitudinally adjustable relationship therewith. First member 174 snappingly and releasably retains second member 176 against first member 174.

Alternate embodiments of snapping first member 174 and second member 176 together are acceptable. In addition, the configuration of first member 174 and second member 176 could be reversed and be equally effective in carrying out the intended function thereof. Alternately, second member 176 could be attached to alternate places on headband 148 and be equally effective. For example, second member 176 of the first adjustment means could be connected to first surface 160 of elongated strip 150 instead of inside 48 of cap 34. The important feature of the first and second adjustment means is allowing longitudinal adjustment by the wearer to selectively size the hat.

The second adjustment means has a configuration similar to the first adjustment means. The second adjustment means comprises a first member and a second member, 178 and, respectively. Second member of the second adjustment means is not visible in FIG. 4, however, second member of the second adjustment means is similar to second member 176 of the first adjustment means.

First member 178 of the second adjustment means is connected to second end 172 of sizing band 168. Second member of the second adjustment means is disposed at second end 154 of headband 148 between inside 48 of cap 34 and first surface 160 of elongated strip 150 when elongated strip 150 is inside cap 34. In this embodiment of a second adjustment means, second member is attached to inside 48 of cap 34 at second end 154 of headband 148.

After wearer 12 has connected longitudinally and adjusted the first and second adjustment means to size the cap, elongated strip 150 is tucked inside cap 34. Elongated strip 150 is then attached to inside 48 of cap 34 by the retaining means comprising, by way of example, first retaining member 164 and second retaining member 166.

Figure 5:
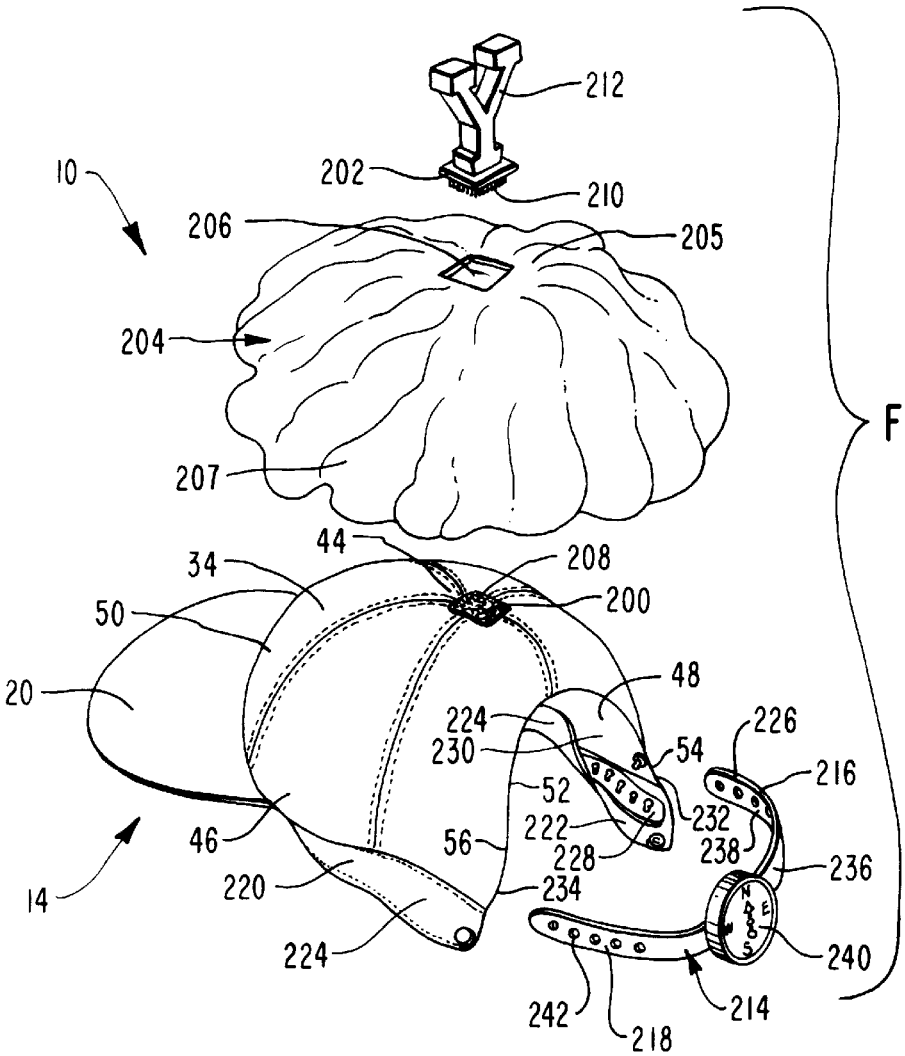
FIG. 5 is an exploded perspective view of an alternate embodiment of head wear system incorporating teachings of the present invention utilizing a sizing band distinct from the hat of the system and structures by which to attach the sizing band to the hat.

An alternate embodiment of structures performing the function of cover means according to the teachings of the present invention is shown in FIG. 5. Cover 204 is loose and blousy and has a configuration similar to cover 130 in FIG. 4. Cover 204 comprises a panel 205 that has an aperture 206 formed through the interior of the perimeter thereof and a skirt 207. The attachment means selectively nondestructively connects cover 204 and ornament 212 to crown 44 of cap 34. By way of example and not limitation, one possible embodiment of structures performing the function of an attachment means according to the teachings of the present invention is illustrated in FIG. 5. Similar to the attachment means in FIGS. 2–4, the attachment means shown in FIG. 5 comprises a first element 200 and a second element 202.

First element 200 of the attachment means is connected to crown 44 of cap 34. Second element 202 of the attachment means releasably cooperates with first element 200 through aperture 206 to engage first element 200. Second element 202 is remote from cap 34.

In this embodiment the attachment means comprises a hook and pile fastener. First element 200 of the attachment means has hooked locking fibers. Second element 202 has cooperating eyelet fibers that are releasably engaged by first element 200 and are adapted to receive the hooked locking fibers on first element 200.

First element 200 and second element 202 of the attachment means have cooperating mating sides, 208 and 210 respectively. Mounted to second element 202 at a location remote from hat 14 is ornament 212. Ornament 212 may be of any shape, including a novelty item. By way of example, ornament 212 is in the shape of a recognized symbol for a sports team or school.

An alternate embodiment of structures performing the function of a first adjustment means and a second adjustment means according to the teachings of the present invention are also shown in FIG. 5. Sizing band 214 has a first end 216 and second end 218. The first adjustment means selectively nondestructively attaches first end 216 of sizing band 214 to first end 232 of headband 230 in a longitudinal relationship therebetween selected by wearer 12. The second adjustment means selectively nondestructively attaches second end 218 of sizing band 214 to second end 234 of headband 230.

First member 226 of the first adjustment means is attached to first end 216 of sizing band 214. In contrast to first member 174 of the first adjustment means in FIG. 4, first member 226 of the first adjustment means and first member 242 of the second adjustment means shown in FIG. 5 each comprise a flexible member having a series of apertures. Second member 228 of first adjustment means and second member of second adjustment means, correspondingly each comprise a flexible member having a series of aligned protuberances allowing longitudinal adjustment selected by wearer 12. Second member 228 of the first adjustment means is attached to first surface 222 of elongated strip 220 at first end 232 of headband 230. Second member of the second adjustment means, which is not visible in FIG. 5, is attached to first surface 222 of elongated strip 220 at second end 234 of headband 230 in a similar manner.

When elongated strip 220 is tucked into place so that first surface 222 of elongated band 220 contacts inside 48 of cap 34, the first and second adjustment means are disposed between first surface 222 and inside 48 of cap 34. According to one aspect of the teachings of the present invention a structure performing the function of a selective retaining means are similar to first retaining member 164 and second retaining member 166 in FIG. 4 and comprise a plurality of snaps for releasably securing elongated strip 220 to cap 34 at first end 232 and second end 234 of headband 230.

Mounted on outside surface 236 of sizing band 214 is decoration 240 comprising, by way of example, a compass.

Figure 6:
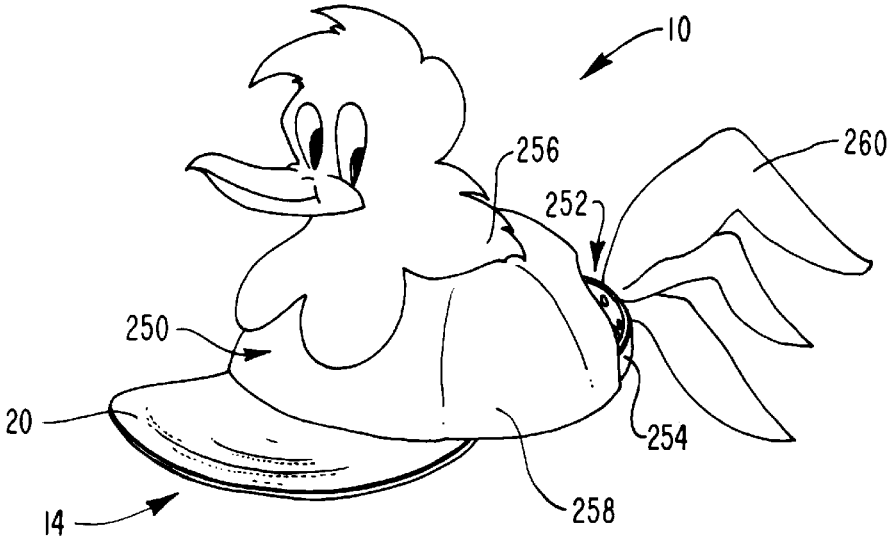
FIG. 6 is a perspective view of an alternate embodiment of a head wear system incorporating the teachings of the present invention and illustrating one embodiment of a cover and structures by which attach the cover to the hat of the system.

FIG. 6 illustrates head wear system 10 when used as novelty head wear. An alternate embodiment of structures performing the function of a cover means according to the teachings of the present invention is shown in FIG. 6. Cover 250 comprises panel 256 and skirt 258. Panel 256 is selectively nondestructively connectable to and overlies crown 44 of hat 14. Skirt 258 is attached to panel 256 and extends radially outward from panel 256. In FIG. 6, panel 256 and skirt 258 are configured as the head of an animal, specifically a rooster. Other embodiments of the cover means that are shaped as different animals are equally effective in carrying out the intended function of the cover means.

Cover 250 is attached to hat 14 by an attachment means which is not shown in this figure. Any of the various embodiments of an attachment means are equally effective in carrying out the intended function thereof.

Sizing band 252 comprises decoration 260 which is mounted on outside surface 254 of sizing band 252. In FIG. 6, decoration 260 has the configuration of a rooster tail. Decoration 260 may, however, take any form.

Figure 7:
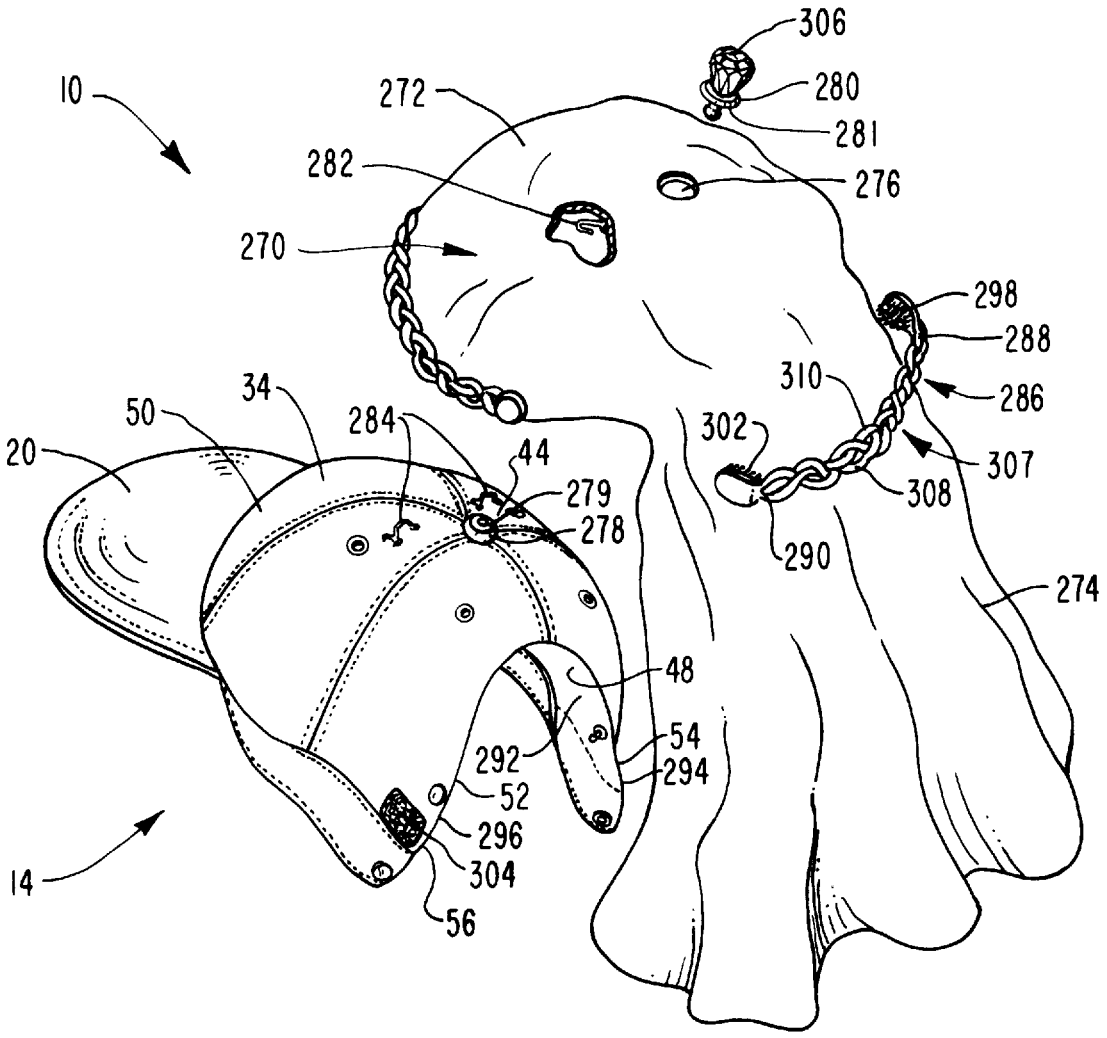
FIG. 7 is an exploded perspective view of an alternate embodiment of head wear system incorporating teachings of the present invention and illustrating one embodiment of a structure by which attach the cover to the hat of the system.

An alternate embodiment of a structure performing the function of a cover means is shown in FIG. 7. Cover 270 comprises panel 272 and skirt 274. The panel 272 is selectively nondestructively connectable to crown 44 of hat 14 by an attachment means and panel 272 overlies crown 44. Skirt 274 extends radially outward from panel 272 which has an aperture 276 formed through interior of the perimeter thereof. In this embodiment of the cover means, skirt 274 has sufficient length to cover at least the side and back of the neck of wearer 12 to protect wearer 12 from the sun. Cover 270 also comprises a water resistant material to protect wearer 12 from precipitation.

Cover 270 is connected to cap 34 by one embodiment of a structure performing the function of an attachment means according to the teachings of the present invention. FIG. 7 illustrates that in addition to comprising first snap element 278 and second snap element 280, similar to first snap element 64 and second snap element 66 of FIG. 2, the attachment means in FIG. 7 may include hooks 282 and cooperating eyes 284, each adapted to receive a hook 282. In this embodiment of the attachment means, eyes 284 are attached to cap 34 and hook 282 is attached to cover 270.

An alternate embodiment of the attachment means which reverses the position of the hooks and eyes would be equally effective in carrying out the intended function of the attachment means. The hook 282 or eye 284 could be mounted anywhere on crown 44 of cap 34.

An alternate embodiment of structures performing the function of an attachment means according to the teachings of the present invention is also shown in FIG. 7. The attachment means comprises first snap element 278 and second snap element 280. First snap element 278 and second snap element 280 have cooperating mating sides 279 and 281, respectively. Mounted to second snap element 280 at a location distinct from mating side 281 of second snap member 280 is ornament 306. In this embodiment of head wear system 10, ornament 306 is configured as a jewel to match the theme of cover 270. Ornament 306 could be any shape or theme.

Also shown in FIG. 7 is an alternate embodiment of structures performing the function of a first and second adjustment means according to the teachings of the present invention. Sizing band 286 has a first end 288 and a second end 290. The first adjustment means selectively and nondestructively attaches first end 288 of sizing band 286 to outside 50 of cap 34 at first side 54 of opening 52 in a longitudinal relationship therebetween selected by wearer 12. Second end 290 of sizing band 286 is attached by the second adjustment means to outside 50 of cap 34 at second side 56 of opening 52 in a longitudinal relationship therebetween selected by wearer 12.

The first adjustment means comprises a first member 298 and a second member. First member 298 of the first adjustment means is attached to first end 288 of sizing band 286. Second member is attached to outside 50 of cap 34 at first side 54 of opening 52. Second member is not shown in FIG. 7, however, second member of the first adjustment means has the same configuration as second member 304 of the second adjustment means discussed next.

The second adjustment means comprises a first member 302 and a second member 304. First member 302 of the second adjustment means is attached to second end 290 of sizing band 286. Second member 304 of second adjusting means is attached to outside 50 of cap 34 at second side 56 of opening 52.

In this embodiment, the first and second adjustment means comprise cooperating hook and pile fasteners similar to those in FIG. 2. Unlike first member 88 of first adjustment and first member 92 of the second adjustment means in FIG. 2, first members 298 and 302 in FIG. 7, are connected to inside surface 310 of sizing band 286. Various embodiments of the adjustment means using attaching methods that allow longitudinal adjustments, including snaps or hooks and eyes, are equally effective in carrying out the intended function thereof.

Sizing band 286 may be worn either under or over skirt 274 of cover 270. Sizing band 286 also comprises decoration 307 which includes interwoven elongated members 308 that are integral with sizing band 286.

Figure 8:
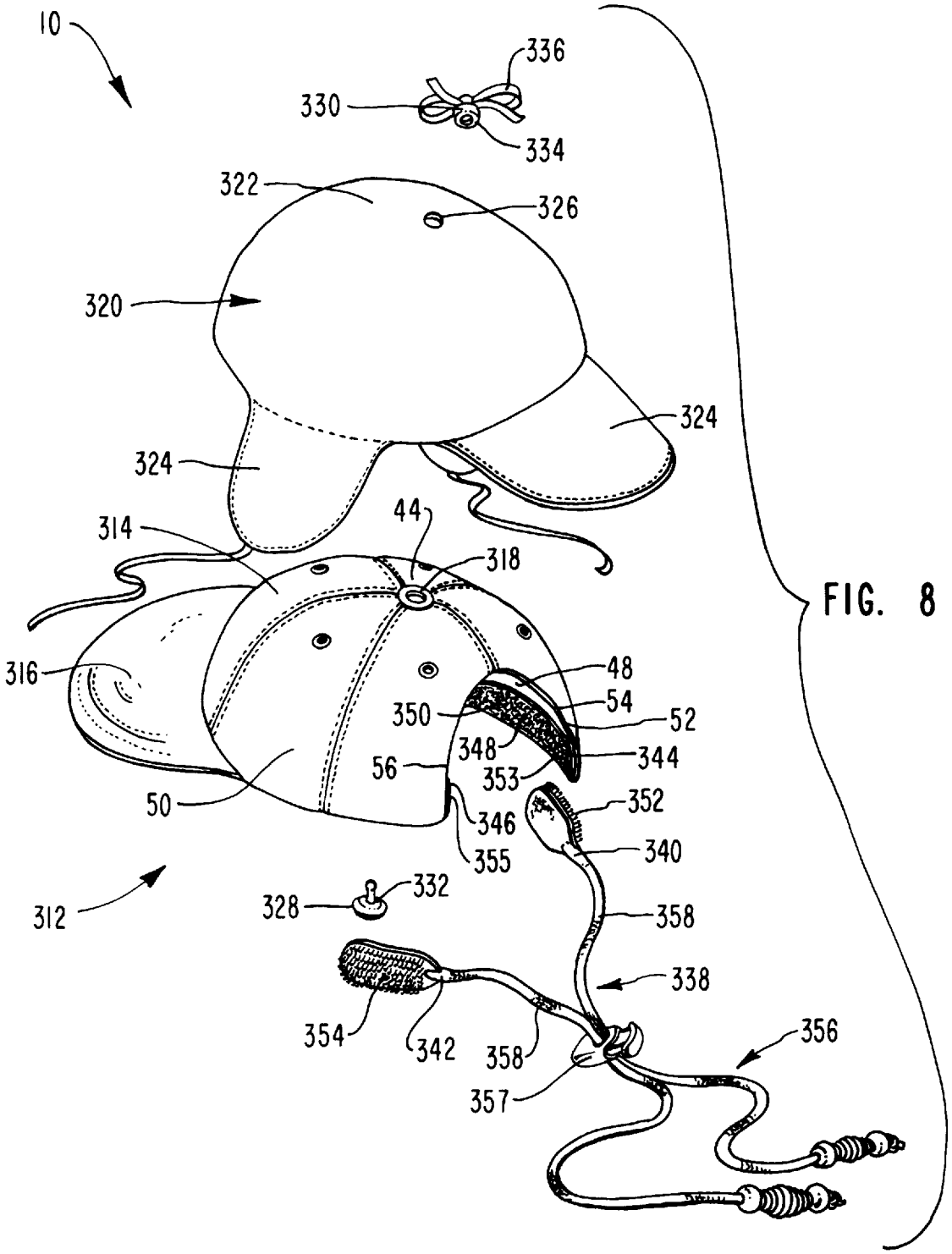
FIG. 8 is an exploded perspective view of an alternate embodiment of a head wear system.

An alternate embodiment of hat 312 is illustrated in FIG. 8 and is similar to hat 14 in FIGS. 2–7. Hat 312 comprises a bill 316 and a cap 314. By contrast to cap 34 in FIGS. 2–7, cap 314 in FIG. 8 has an aperture 318 in crown 44 which will be discussed in more detail below.

An alternate embodiment of the structures performing the function of a cover means according to the teachings of the present invention is shown as cover 320 in FIG. 8 and comprises a panel 322 and a skirt 324. Panel 322 is selectively nondestructively connectable to crown 44 by an attachment means with panel 322 overlying crown 44 of hat 312. Panel 322 has an aperture 326 formed through the interior of the perimeter thereof. Skirt 324 extends radially outward from panel 322 and in this embodiment the cover means comprises skirt 324 which covers the ears and neck of wearer 12 from precipitation and also provides warmth. Various embodiments of the cover means are equally effective in carrying out the intended function thereof.

An alternate embodiment of structures performing the function of an attachment means according to the teachings of the present invention are shown in FIG. 8. Cover 320 is selectively nondestructively connected to cap 314 by an attachment means comprising a first snap element 328 and a second snap element 330.

First snap element 328 is disposed in aperture 318 of cap 314 and aperture 326 in panel 322. First snap element 328 and second snap element 330 have cooperating mating sides 332 and 334, respectively. First snap element 328 snappingly retains mating side 334 of second snap element 330 against mating side 332 of first snap element 328. Mounted to second snap element 330 at a location distinct from mating side 334 of second element 330 is ornament 336. In this embodiment of head wear system 10, ornament 336 is configured as a bow.

Sizing band 338 comprises decoration 356. In one embodiment shown in FIG. 8, decoration 356 comprises two rope-like pieces 358 and a fitting piece 357. Fitting piece 357 is slidably attached to rope-like pieces 358 and connects them together to form sizing band 338. Fitting piece 357 controls the vertical distance of opening 52 between rope-like pieces 358 and cap 314. This enables wearer 12 to push longer hair out of opening 52 and keeps the hair in place by vertically adjusting fitting piece 357 against the hair. Various embodiments of sizing band 338 are equally effective in carrying out the intended function thereof.

Sizing band 338 has first end 340 and second end 342. First end 340 of sizing band 338 is selectively nondestructively attached to first end 344 of headband 348 by a first adjustment means in a longitudinal relationship selected by wearer 12. Similarly second end 342 of sizing band 338 is selectively nondestructively attached to second end 346 of headband 348 by a second adjustment means.

FIG. 8 also illustrates an alternate embodiment of structures performing the function of a first adjustment means and a second adjustment means according to the teachings of the present invention. In this embodiment of head wear system 10, headband 348 comprises an elongated strip 350 attached to inside 48 of cap 314. Elongated strip 350 also forms a portion of the first and second adjustment means as will be discussed in more detail. The first adjustment means comprises a first member 352 and a second member 353, which is actually a portion of elongated strip 350. In other words, first end 344 of headband 348 is also second member 353 of the first adjustment means.

The second adjustment means comprises a first member 354 and a second member 355. Similar to the first adjustment means, second member 355 is actually a portion of elongated strip 350. In this case, second end 346 of headband 348 also functions as second member 355 of the second adjustment means. Second member 355 of the second adjustment means is not visible in FIG. 8, however, second member 353 of the first adjustment means is similarly configured. First members 352 and 354 of the first and second adjustment means, respectively, comprise hooked locking fibers. In this embodiment elongated strip 350 has cooperating eyelet fibers that are releasably engaged by first members 352 and 354.

Figure 9:
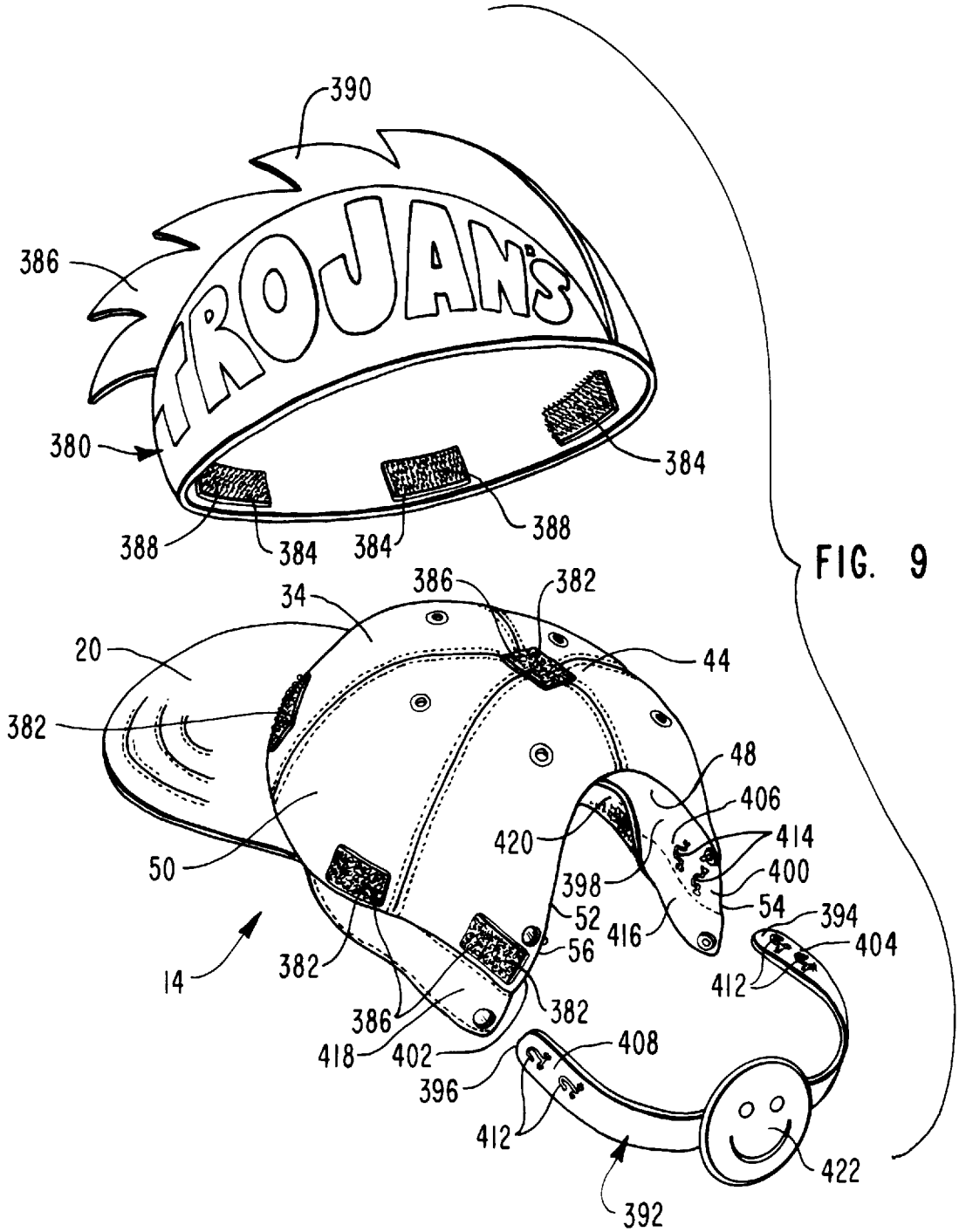
FIG. 9 is an exploded perspective view of an alternate embodiment of a head wear system incorporating teachings of the present invention and illustrating one embodiment of structures by which attach the sizing band to the hat of the system.

An alternate embodiment of structures performing the function of a cover means according to the teachings of the present invention is shown in FIG. 9. Cover 380 has the configuration of a costume or mascot. In this embodiment cover 380 might be worn to show support of a school or sports team. Various embodiments of the cover means for accessorizing hat 14 are equally effective in carrying out the intended function thereof.

An alternate embodiment of structures performing the function of an attachment means according to the teachings of the present invention is shown in FIG. 9. Cover 380 is attached to cap 34 by the attachment means. Similar to the attachment means in FIG. 5, the attachment means in FIG. 9 also comprises hook and pile fasteners. FIG. 9 illustrates a plurality of attachment means with each comprising a first element 382 and a second element 384. First element 382 is attached to cap 34 at crown 44. First element 382 of the attachment means may also be at various locations on outside 50 of cap 34. Second member 384 of the attachment means is attached to cover 380 at positions aligned with each corresponding first element 382.

First element 382 and second element 384 each have a cooperating mating side, 386 and 388, respectively. Mounted to second element 384 at a location distinct from mating side 388 of second element 384, which is aligned with first element 382 on crown 44 of cap 34, is ornament 390. This is not clearly shown in FIG. 9, but it functions essentially the same as the attachment means and ornament 212 in FIG. 5.

An alternate embodiment of structures performing the function of the first and second adjustment means according to the teachings of the present invention are also illustrated in FIG. 9. The first and second adjustment means for selectively nondestructively attaching sizing band 392 to headband 398 in a longitudinal relationship therebetween selected by wearer 12 comprises hooks 412 and eyes 414 adapted to receive hooks 412. Various embodiments of the adjustment means using conventional attaching methods allowing longitudinal adjustment are equally effective in carrying out the intended function thereof.

Sizing band 392 has a first end 394 and a second end 396. First end 394 of sizing band 392 is attached to first end 400 of headband 398 by a first adjustment means. Second end 396 of sizing band 392 is attached to second end 402 of headband 398 by a second adjustment means.

The first and second adjustment means each comprise a first member and a second member. First member 404 of first adjustment means is attached to first end 394 of sizing band 392 and comprises at least one hook 412. Second member 406 of the first adjustment means comprises a plurality of eyes 414 adapted to receive hooks 412 and allowing longitudinal adjustment by wearer 12 to size cap 34. Second member 406 of the first adjustment means is attached to first end 400 of headband 398.

First member 408 of the second adjustment means is attached to second end 396 of sizing band 392 and comprises at least one hook 412. Second member of the second adjustment means is attached to second end 402 of headband 398. Second member is not shown in FIG. 9, but has the same configuration as second member 406 of the first adjustment means. Second member comprises a plurality of eyes 414 adapted to receive hooks 412.

Eyes 414 of second members 400 and are attached to inside 48 of cap 34. Eyes 414 are aligned with hooks 412 to allow longitudinal adjustment by wearer 12. Hooks 412 and eyes 414 could be reversed in position and be equally effective in carrying out the intended function thereof. In addition, second members 400 and could be moved to first surface 416 of elongated strip 420 and be equally effective in carrying out the intended function thereof. Similar to the embodiments of the first and second adjustment means in FIGS. 4 and 5, the first and second adjustment means in FIG. 9 are disposed between first surface 416 of elongated strip 420 and inside 48 of cap 34. Various embodiments of the adjustment means are equally effective in carrying out the intended function thereof.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within the scope thereof.

What is claimed is:

1. A head wear system comprising:

(a) a hat having a front, a back, a crown, and a base;

(b) an ornament;

(c) attachment means, connected to said ornament, for selectively nondestructively connecting said ornament to said crown of said hat, said attachment means holding said ornament in a fixed position relative to said hat, said attachment means comprises:

(i) a first element; and (ii) a second element releasably cooperable with said first element to connect said ornament to said crown of said hat, said second element being remote from said hat, each of said first element and said second element having a cooperating mating side, said second element having said ornament mounted thereto at a location distinct from said mating side of said second element; and (d) cover means for accessorizing said hat, said cover means being selectively nondestructively connectable to said hat by said attachment means.

2. A head wear system as recited in claim 1, wherein:

(a) said first element has hooked locking fibers; and (b) said second element has cooperating eyelet fibers that are releasably engaged by said first element.

3. A head wear system as recited in claim 1, wherein:

(a) said first element of said attachment means comprises a hook; and (b) said second element of said attachment means comprises an eye adapted to receive said hook.

4. A head wear system as recited in claim 1, wherein said first element of said attachment means is connected to said hat.

5. A head wear system as recited in claim 1, wherein:

(a) an aperture is formed through said hat; and (b) said second element of said attachment means releasably cooperates with said first element through said aperture to engage said first element.

6. A head wear system as recited in claim 1, wherein said cover means comprises a panel, and said panel being selectively nondestructively connectable to said crown of said hat by said attachment means with said panel overlying said crown of said hat.

7. A head wear system as recited in claim 6, wherein:

(a) an aperture is formed through said panel;

(b) said first element of said attachment means is connected to said hat; and (c) said second element of said attachment means is releasably cooperable with said first element of said attachment means through said aperture to engage said first element.

8. A head wear system as recited in claim 6, wherein:

(a) an aperture is formed through said panel;

(b) an aperture is formed through said hat; and (c) said second element of said attachment means releasably cooperable with said first element through said aperture in said hat and said aperture in said panel to engage said first element when said apertures are aligned.

9. A head wear system as recited in claim 6, wherein visual indicia is displayed on said cover means.

10. A head wear system as recited in claim 6, wherein said cover means further comprises a water resistant material.

11. A head wear system as recited in claim 6, wherein said cover means further comprises a skirt attached to said panel, said skirt extending radially outward from said panel.

12. A head wear system as recited in claim 11, wherein said skirt has sufficient length to cover the neck of a wearer of said hat.

13. A head wear system as recited in claim 11, wherein said skirt is designed to cover the ears of a wearer of said hat.

14. A head wear system as recited in claim 11, wherein said panel and said skirt are loosely overlying said cap, said panel and said skirt have sufficient size to be formed into multiple shapes while being attached to said cap.

15. A head wear system as recited in claim 11, wherein said panel and said skirt are so configured as to generally conform to the shape of said cap.

16. A head wear system as recited in claim 11, wherein said panel and said skirt are shaped as an animal feature.

17. A head wear system as recited in claim 11, wherein said panel and skirt are shaped as a costume or mascot.

18. A head wear system comprising:

(a) a hat comprising:

(i) a cap having a front, a back, a crown, and a base, (ii) a bill attached to said base of said cap at said front thereof, said bill extending outwardly from said front of said cap;

(b) an ornament;

(c) cover means for accessorizing said hat; and (d) attachment means for selectively nondestructively connecting said cover means and said ornament to said crown of said cap.

19. A head wear system as recited in claim 18, wherein:

(a) said cover means comprises a panel, and said panel being selectively nondestructively connectable to said crown of said cap by said attachment means with said panel overlying said crown of said cap; and (b) said attachment means comprises:

(i) a first element; and (ii) a second element releasably cooperable with said first element to engage said first element.

20. A head wear system as recited in claim 19, wherein:

(a) said first element and said second element having cooperating mating sides; and (b) said ornament is mounted to said second element at a location distinct from said mating side of said second element.

21. A head wear system as recited in claim 20, wherein:

(a) said first element of said attachment means is connected to said cap; and (b) said second element is releasably engaged to said first element.

22. A head wear system as recited in claim 20, wherein:

(a) an aperture is formed through said cap;

(b) said second element of said attachment means releasably cooperates with said first element through said aperture to engage said first element.

23. A head wear system as recited in claim 20, wherein:

(a) an aperture is formed through said panel;

(b) said first element of said attachment means is connected to said cap; and (c) said second element of said attachment means releasably cooperable with said first element of said attachment means through said aperture to engage said first element.

24. A head wear system as recited in claim 20, wherein:

(a) an aperture is formed through said, panel;

(b) an aperture is formed through said cap; and (c) said second element of said attachment means releasably cooperable with said first element through said aperture in said cap and said aperture in said panel to engage said first element when said apertures are aligned.

25. A head wear system comprising:

(a) a hat comprising:

(i) a cap having a front, a back, a crown, and a base; and (ii) a bill attached to said base of said cap at said front thereof, said bill extending outwardly from said front of said cap; and (b) cover means for accessorizing said cap, said cover means comprising a panel, and said panel overlies said crown of said cap;

(c) a snap comprising:

(i) a first snap element;

(ii) a second snap element, said first snap element and second snap have cooperating mating sides for selectively nondestructively connecting said panel to said crown of said cap, said second snap element further being remote from said cap; and (d) an ornament mounted to said second snap element at a location distinct from said mating side of said second snap element, said ornament being visible even when said cover means is attached to said cap.

26. A head wear system as recited in claim 25, wherein:

(a) an aperture is formed through said panel;

(b) said first snap element of said snap is connected to said cap; and (c) said second snap element releasably cooperates with said first snap element through said aperture to engage said first snap element.

27. A head wear system as recited in claim 26, wherein visual indicia is displayed on said cover means.

* * * * *